US007530755B2

(12) United States Patent
Whaley

(10) Patent No.: US 7,530,755 B2
(45) Date of Patent: May 12, 2009

(54) EASY OPEN RING BINDER

(75) Inventor: Paul A. Whaley, Pevely, MO (US)

(73) Assignee: U.S. Ring Binder, L.P., St. Louis, MO (US)

( * ) Notice: Subject to any disclaimer, the term of this patent is extended or adjusted under 35 U.S.C. 154(b) by 822 days.

(21) Appl. No.: 11/100,679

(22) Filed: Apr. 7, 2005

(65) Prior Publication Data

US 2006/0088364 A1 Apr. 27, 2006

Related U.S. Application Data

(60) Provisional application No. 60/620,822, filed on Oct. 21, 2004.

(51) Int. Cl.
*B42F 3/04* (2006.01)
*B42F 13/20* (2006.01)

(52) U.S. Cl. ..... 402/38

(58) Field of Classification Search ..... 402/19, 402/20, 23, 26, 31, 35–39, 41, 42, 70, 73, 402/76, 77

See application file for complete search history.

(56) References Cited

U.S. PATENT DOCUMENTS 566,717 A 8/1896 Krah
651,254 A 6/1900 Krah
842,851 A 2/1907 Boden
924,647 A 6/1909 Eddy
974,831 A 11/1910 Scherzinger
1,157,154 A 10/1915 Schade, Jr.
1,667,744 A * 5/1928 Skiles ..... 402/33
2,103,307 A 12/1937 Unger
2,364,859 A 12/1944 Lichtenstein
2,612,169 A * 9/1952 Segal ..... 402/38
3,077,888 A * 2/1963 Thieme ..... 402/38
3,153,417 A 10/1964 Newman
3,995,961 A 12/1976 Dorfman (Continued)

OTHER PUBLICATIONS

Search Report from corresponding European Patent Application No. 05022927.7.

*Primary Examiner*—Derris H. Banks
*Assistant Examiner*—Kyle Grabowski
(74) *Attorney, Agent, or Firm*—Polster, Lieder, Woodruff & Lucchesi, LC

(57) ABSTRACT

A ring metal (10) has binder rings (12-16) each comprised of two ring segments one end of each of which is attached to a hinge plate (18, 20). A movable bar (34) extends from one end of the metal to the other and contacts the hinge plates to move them when the binder is opened. A manually operated trigger (32) connects to one end of the bar to move the bar. The trigger includes a slot (40) in which is fitted a pin (44) connected to the bar. The pin moves in the slot as the trigger is moved. Drawing the trigger away from a binder closed position toward a binder open position moves the pin through the slot. This causes the bar to move relative to the hinges, forcing the hinges to pivot the respective segments of each binder ring away from each other and open the binder. When the binder is closed, a nib (62) formed on the top of the bar is received in an opening in a shield (22) of the metal to prevent the trigger from being inadvertently moved and opening the binder.

7 Claims, 4 Drawing Sheets

U.S. PATENT DOCUMENTS 4,566,817 A 1/1986 Barrett, Jr.
4,571,108 A 2/1986 Vogl
6,276,862 B1 * 8/2001 Snyder et al. ..... 402/40
6,364,558 B1 4/2002 To
6,749,357 B2 6/2004 Cheng
6,758,621 B2 7/2004 To
6,840,695 B2 1/2005 Horn
6,916,134 B2 * 7/2005 Wong ..... 402/26
7,296,946 B2 11/2007 Cheng et al.
2002/0122687 A1 9/2002 Horn
2003/0103797 A1 6/2003 Cheng
2003/0103798 A1 6/2003 Cheng et al.
2004/0013464 A1 1/2004 Cheng
2005/0013654 A1 1/2005 Cheng et al.

* cited by examiner

EASY OPEN RING BINDER

CROSS REFERENCE TO RELATED APPLICATIONS

U.S. provisional patent application No. 60/620,822 filed Oct. 21, 2004.

STATEMENT REGARDING FEDERALLY SPONSORED RESEARCH OR DEVELOPMENT

N/A

BACKGROUND OF THE INVENTION

This invention relates to ring binders for holding paper and the like, and more particularly, a ring binder which is easier to open than conventional ring binders.

Conventional ring binders employ a pair of thumb or finger operated trigger mechanisms, one located at each end of a "metal". The metal includes two or more binder rings connected to a lever movable by the trigger mechanism to open and close the binder. Heretofore, the force required to operate the trigger has been relatively substantial. One reason for this is that the metal is designed to not inadvertently open if a binder is, for example, dropped. Accordingly, conventional metals have been designed to withstand a reasonable amount of force and remain closed. While these metals have functioned well for their intended purpose, it has recently been recognized that it would be advantageous to employ a metal which, while it stays closed when dropped or otherwise mishandled, requires substantially less force by a user to open it when the user desires to open the binder.

Various approaches to easy open type ring metals are disclosed in U.S. Pat. No. 6,749,357, and published U.S. patent applications 2005/0013654, 2003/0103798, and 2003/0103797. However, the structures shown and described therein are more complex and costly than the invention described herein.

BRIEF SUMMARY OF THE INVENTION

The present invention is directed to an easy-open ring metal for a binder holding hole punched sheets of paper or the like. The metal includes two or more binder rings each of which comprises two curved ring segments one end of each of which is attached to a hinge plate. The other ends of the respective ring segments mate with each other when the binder is closed, but are separated from each other when the plates are moved to open the binder. A movable bar extends from one end of the metal to the other and contacts the hinge plates to move them when the binder is opened. A thumb or finger operated trigger is connected to one end of the bar to move the bar. The trigger includes a slot in which is fitted a pin attached to one end of the bar. The pin moves in the slot as the trigger is moved by a user of the binder. Drawing the trigger away from a first, binder closed position, to a second, binder open position, draws the pin through the slot from one end of the slot to the other. This, in turn, moves the bar against the hinges and forces the hinges to pivot the respective segments of each binder ring away from each other and open the binder. When the binder is closed, a nib formed on the top of the bar is received in an opening in a shield of the metal, which covers the bar and hinge plates, to prevent the trigger from being inadvertently moved and opening the binder.

Other objects and features will be in part apparent and in part pointed out hereinafter.

BRIEF DESCRIPTION OF THE SEVERAL VIEWS OF THE DRAWINGS

The objects of the invention are achieved as set forth in the illustrative embodiments shown in the drawings which form a part of the specification.

Corresponding reference characters indicate corresponding parts throughout the several views of the drawings.

DETAILED DESCRIPTION OF INVENTION

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention. As various changes could be made in the above constructions without departing from the scope of the invention, it is intended that all matter contained in the above description or shown in the accompanying drawings shall be interpreted as illustrative and not in a limiting sense.

Figure 3:
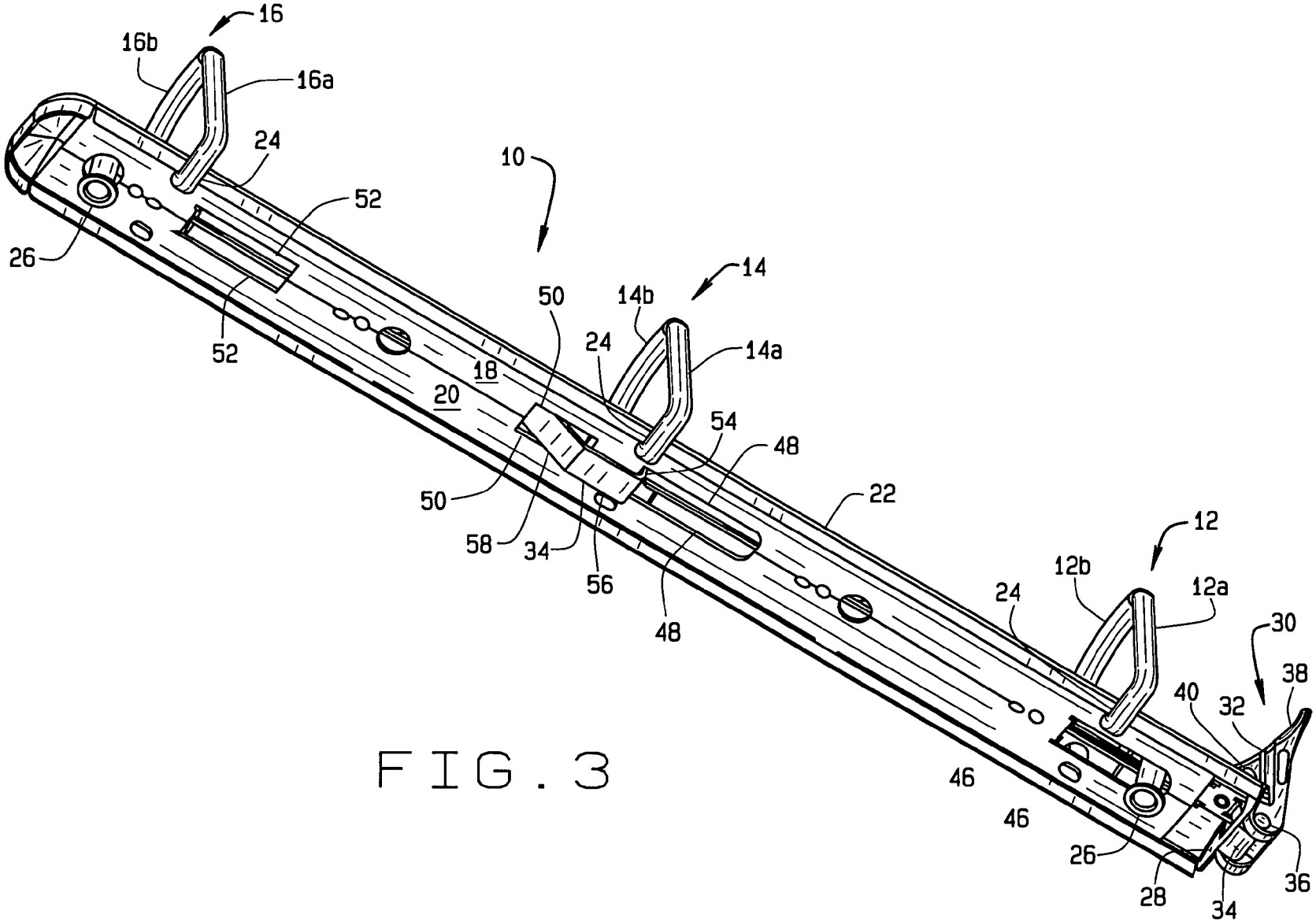
FIG. 3 is a perspective view of the underside of the metal in the binder closed position.
Figure 6:
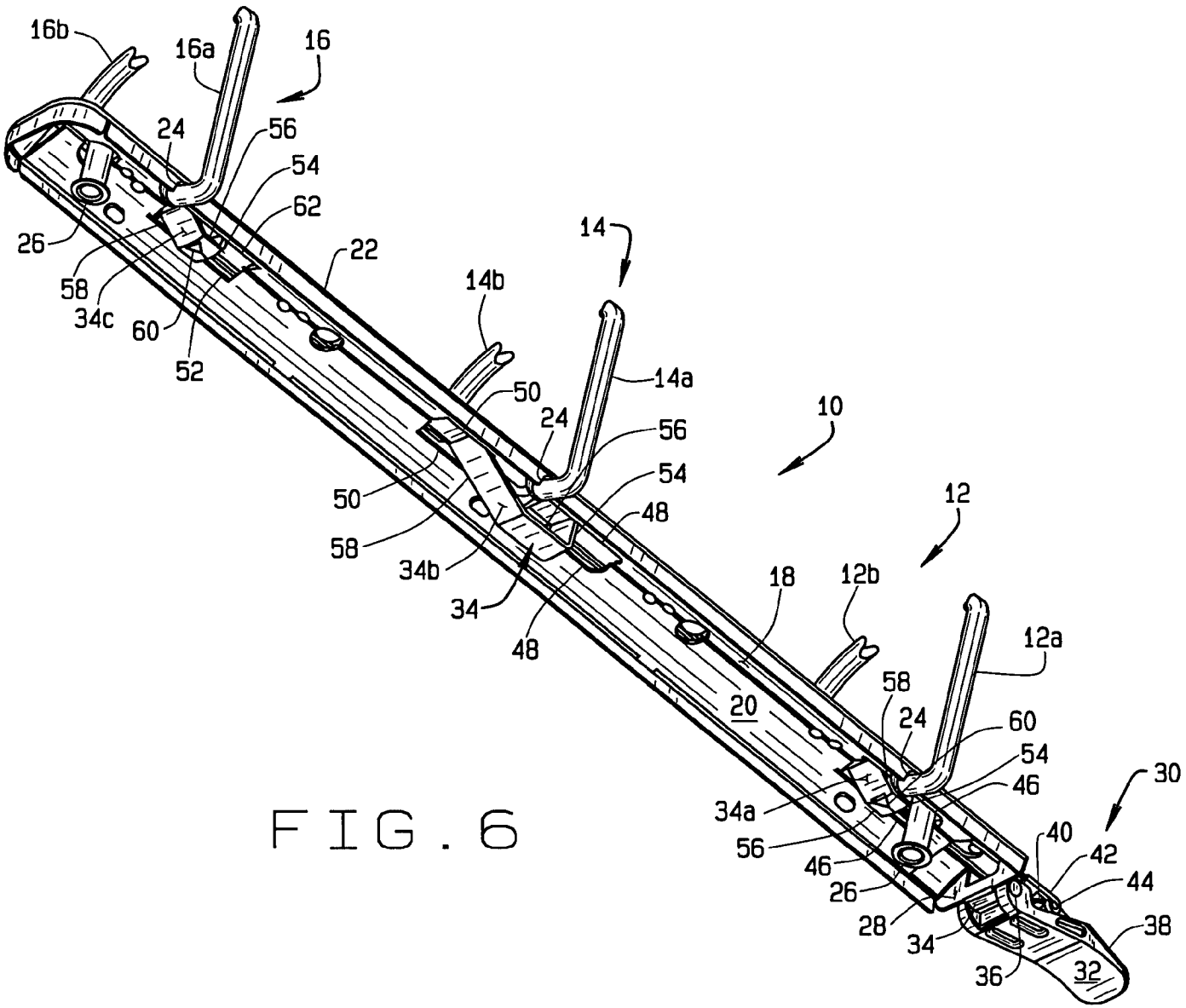

Referring to the drawings, a "metal" for use in a ring binder is indicated generally 10 and is attached to the spine portion of a binder (not shown) in a conventional manner. Although referred to as a metal throughout this description, those skilled in the art will understand that metal 10 can be of either a metal or a plastic construction, or a combination thereof. The metal includes three spaced rings 12, 14, and 16 each of which is comprised of two curved ring segments 12*a*, 12*b*, 14*a*, 14*b*, and 16*a*, 16*b* respectively. The rings 12 and 16 are located adjacent each end of the ring metal, while ring 16 is located midway the length thereof. Each ring segment has one end attached to a hinge plate 18, 20 respectively. The hinge plates are each rectangular plates which extend side-by-side, parallel to each other, substantially the length of the metal. When the binder rings are closed as shown in FIG. 3, the plates are generally flat. However, when the plates are flexed as shown in FIG. 6, the movement of the plates causes the outer, mating ends of the respective rings to separate from each other and open the binder. Those skilled in the art will understand that ring metal 10 could have more or fewer rings without departing from the scope of the invention.

A cover or shield 22 extends the length of the metal. The shield covers the hinge plates and has spaced openings 24 through which the respective ring segments extend. A pair of posts 26, one post being located at each end of the cover, extend from the underside of the cover. The posts are used for securing metal 10 to the binder spine using rivets or the like, all as is well-known in the art.

A trigger mechanism, indicated generally 30, includes a trigger 32 located at one end of the ring metal and a bar 34 attached to the trigger and extending the length of the metal. Trigger 32 is rotatably secured to one end of cover 22. As shown in FIG. 3, an end wall 28 of cover 22 has an outwardly extending protrusion 34. Trigger 32 has a pivot pin 36 extending transversely across the base of the trigger, and protrusion 34 is curled at its outer end so to enclose an intermediate portion of the pin and secure the trigger to the end of the metal. This means of attachment allows the trigger to pivot about the pin from an upright, generally vertical position, as shown in FIGS. 1-4, to a substantially horizontal position as shown in FIGS. 5 and 6. Pivot pin 36 therefore provides an axis of rotation for trigger 32.

The trigger includes a thumb pad or finger pad 38 formed on an upper, inner face of the trigger so a user can apply pressure to the trigger and rotate it about its axis of rotation. The upper, inner face of the trigger slopes inwardly from the upper end of the trigger toward end wall 28 of cover 22, so that at its extreme inner reach, this portion of the trigger overlays the upper surface of the cover. (See FIGS. 2 and 4.) This inner face of the trigger then extends outwardly and downwardly toward the lower, pinned base of the trigger. A transversely extending slot 40 is formed in the trigger, adjacent the inner surface thereof. The slot is a generally straight slot that extends diagonally from the upper, overhanging portion of trigger 32 toward the lower, pinned base of the trigger.

Figure 1:
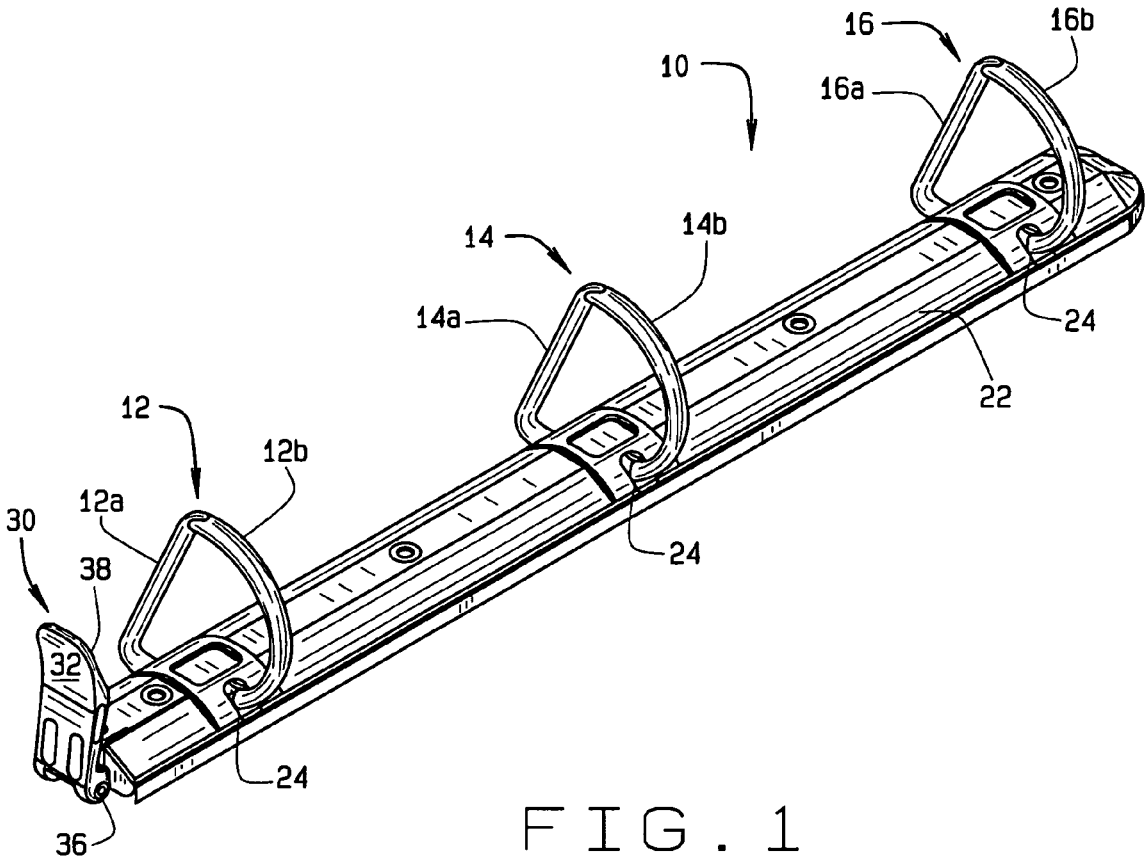
FIG. 1 is a perspective view of an easy-open binder metal of the present invention in a binder closed position.
Figure 2:
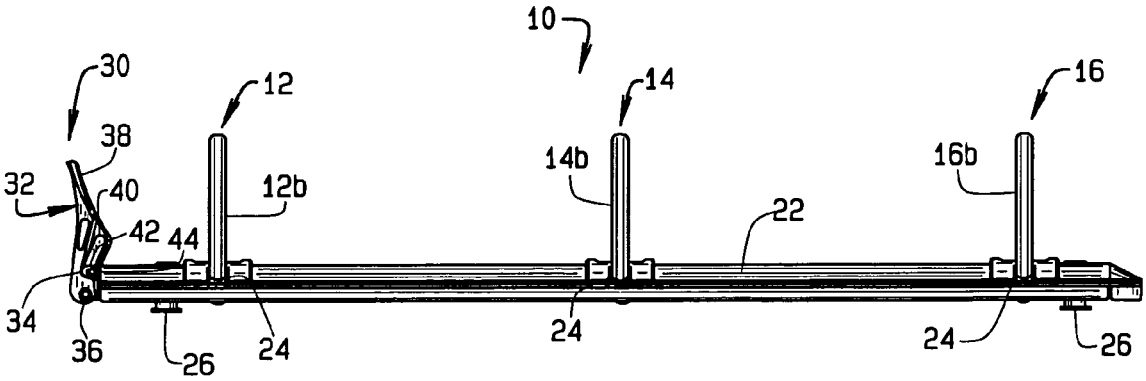
FIG. 2 is a side elevation view of the metal.
Figure 4:
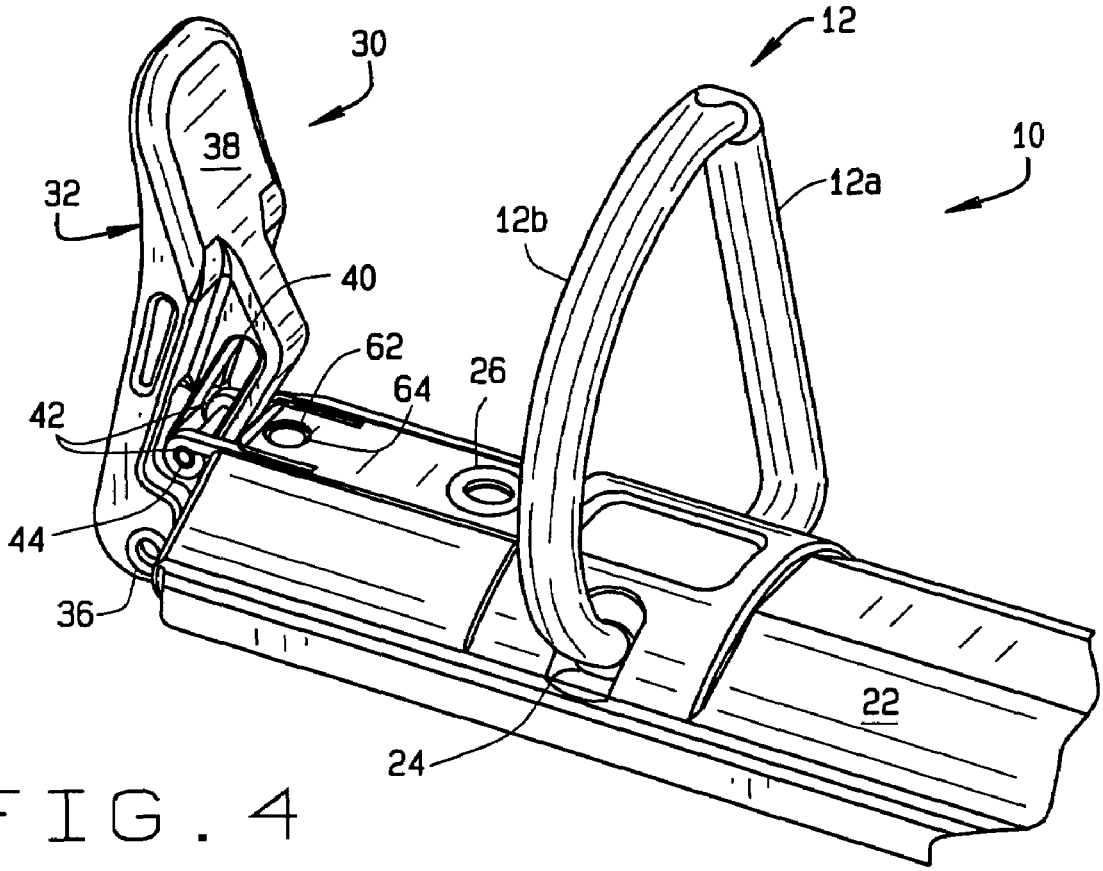
FIG. 4 is a perspective of the trigger mechanism in the binder closed position.
Figure 5:
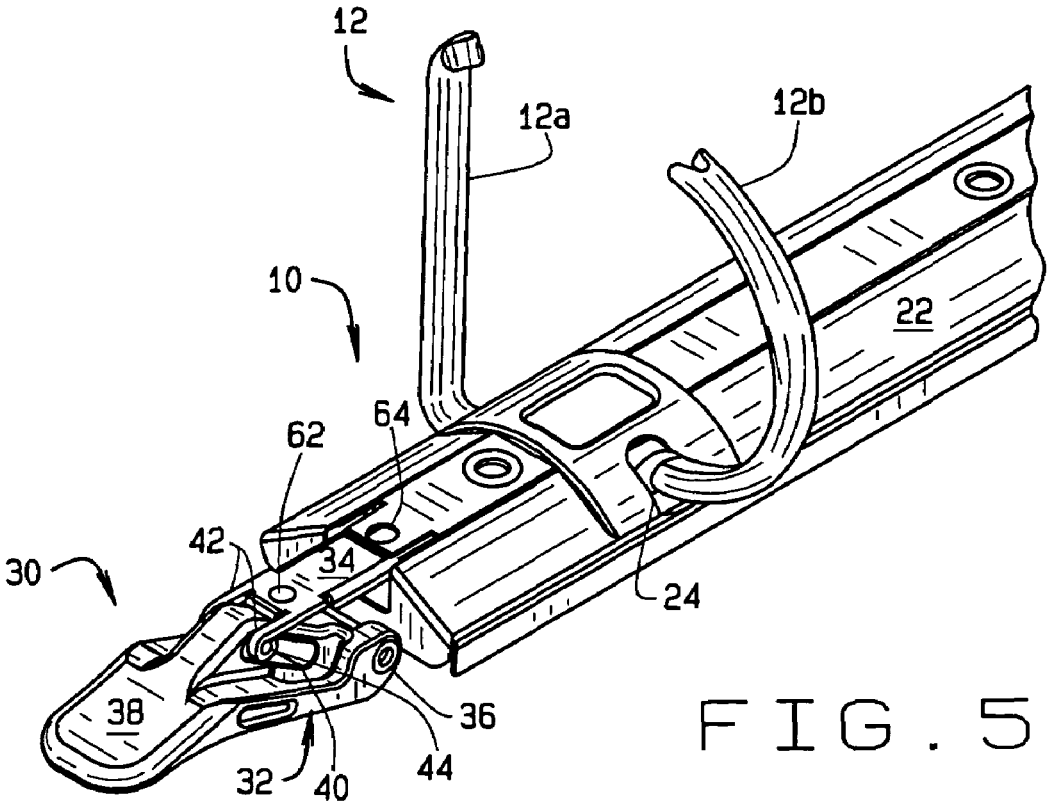
FIG. 5 is a perspective view of the trigger mechanism in the binder open position; and, FIG. 6 is a view similar to FIG. 3 in the binder open position.

Referring to FIGS. 4 and 5, an outer end of bar 34 extends from beneath cover 22. Two prongs 42 project outwardly from the outer end of bar 34, each prong extending longitudinally from opposite sides of the end of the bar. The outer ends of the prongs curl around opposite ends of a pin 44 which extends through slot 40 in trigger 32. The length of pin 44 is greater than the length of slot 40 so the respective outer ends of pin 44 project beyond the respective ends of the slot. The outer ends of pin 44 are captured in the curled outer ends of the prongs 42 to retain pin 44 in slot 40. When trigger 32 is its vertical position and the binder rings are closed, pin 44 rests at the lower end of slot 40. This is as shown in FIGS. 2 and 4. Now, as trigger 32 is pivoted about pin 36 from its position shown in FIG. 4 to its position shown in FIG. 5, pin 44 moves upwardly through slot 40. When the pin reaches the upper end of the slot, continued rotational movement of the trigger draws bar 34 to the left, as shown in FIG. 5. Slot 40 is therefore a "lost motion" slot meaning that initial movement of the trigger does not affect opening of the binder rings. Rather, this begins to occur only after pin 44 has traversed the to the end of the slot.

As shown in FIG. 3, hinge plates 18, 20 have a series of correspondingly spaced and shaped openings 46, 48, 50, and 52. As best shown in FIG. 6, bar 34 comprises a flat, rectangular shaped bar which extends across the abutting edges of hinge plates 18, 20. The bar further has a three raised sections; an inner section 34*a* at the end of the bar adjacent ring 12, an intermediate section 34*b* adjacent ring 14, and an outer section 34*c* adjacent ring 16. Each section 34*a*-34*c* has a vertical face 54 which projects outwardly from the main body of bar 34, a short flat surface 56 extending rearwardly from the outer end of face 54, and a sloping surface 58 which slopes from the rearward end of surface 56 back to the main body portion of the bar.

As shown in FIG. 3, when the rings are closed and trigger 32 is in its upright position, bar sections 34*a* and 34*c* are on the underside of hinge plates 18, 20, between the hinge plates and the underside of cover 22. In this position, they prevent the hinge plates from hinging in a direction to open the binder rings. Section 34*b* of bar 34 spans openings 48, 50 with the vertical face portion of the section seated against one end of opening 48 and with the sloping surface 58 of the section extending through opening 50. When the binder rings are closed, the inner faces of hinges plate 18, 20 bear against the surfaces 56 of bar sections 34*a* and 34*c*. Both of these surfaces have inwardly sloping notches 60 formed therein.

When trigger 32 is rotated to open the binder rings 12, 14, 16, bar 34 is drawn to the rightward, as viewed in FIGS. 3 and 6, and the raised sections 34*a*, 34*c* of the bar are drawn into the respective openings 46, 52 where they can no longer block plates 18, 20 from hinging. As the rear of the flat surfaces 56 of bar sections 34*a*, 34*c* reach the edges of the respective openings 46, 52, the notches 60 allow the hinge plates to begin to fold inwardly. As movement of trigger 32 continues, the rear sloping surfaces 58 of the bar sections 34*a*-34*c* move away from the left edge (as viewed in FIGS. 3 and 6) of the openings 46, 50, and 52 in each of the hinge plates, allowing the plates to fold inwardly so the ring segments separate from each other and open the binder.

When trigger 32 is rotated to close the binder rings, or when the segments of the binder rings are manually pressed together, bar 34 is moved to the left (as viewed in FIGS. 3 and 6). The sloping surfaces 58 of the bar sections 34*a*-34*c* now bear against the left edges of the respective openings, causing hinge plates 18, 20 to rotate outwardly back to their FIG. 3 position in which binder rings are closed.

A problem with conventional ring metals is the "play" which allows the ring segments to partially separate doing ordinary movement of the binder. If the amount of play is too great, the binder rings can inadvertently open allowing the contents of the binder to spill out. Binder metal 10 of the present invention prevents this from happening. As best shown in FIGS. 4 and 5, the end portion of bar 34, just inwardly of where the prongs 42 begin, has a button or nib 62 extending upwardly from the outer face of the bar. A round opening 64, sized for the nib to fit into it, is formed in cover 22. When the binder is closed, as shown in FIG. 4, the nib seats in this opening and prevents movement of trigger 32 and bar 34 by any incidental forces to which the binder is subjected. However, finger or thumb pressure on pad 38 of the trigger is sufficient to draw the nib away from the opening, as shown in FIG. 5, so the binder can be opened.

In view of the above, it will be seen that the several objects and advantages of the present invention have been achieved and other advantageous results have been obtained.

Having thus described the invention, what is claimed and desired to be secured by Letters Patent is:

1. An easy-open ring metal for a binder comprising:

at least one binder ring comprising two ring segments;

a pair of hinge plates to one end of each of which one of the segments is attached;

a movable bar extending from one end of the metal to the other, the bar contacting the hinge plates to move them when the binder is to be opened;

a trigger connected to one end of the bar to move the bar, the bar being connected to the trigger through a slot by which, when the trigger is drawn away from a first, binder closed position, to a second, binder open position, the bar is moved relative to the hinge plates forcing the hinge plates to pivot the respective segments of the binder rings away from each other and open the binder;

a slot pin installed in the slot and the bar having at least one prong projecting outwardly from an end of the bar for attaching the trigger to the bar so, as the trigger pivots about its base, the slot pin moves through the slot until it reaches an end thereof, with continued pivoting of the trigger moving the bar in a direction to effect opening of the binder ring; and, a cover for the metal having an end wall to which the trigger is pivotally connected for opening and closing the binder ring, the end wall having an outward projecting extension, and the trigger having a pivot pin extending transversely across a base of the trigger and pivotally connected to the extension to allow the trigger to pivot about its base to open and close the binder ring.

2. The ring metal of claim 1 in which the bar has a plurality of raised sections which move relative to the hinge plates as the trigger is pivoted, the raised sections acting on the hinge plates to move them in a direction to open the binder ring.

3. The ring metal of claim 2 in which the bar has a series of raised section which bear against one side of the hinge plates when the trigger is in its binder ring closed position, the sections being moved out of contact with the hinge plates when the trigger is rotated so to allow the hinge plates to move.

4. The ring metal of claim 3 in which the hinge plates have a series of spaced openings into which the raised sections of the bar are drawn when the trigger is pivot thereby allowing the hinge plates to move.

5. The ring metal of claim 4 in which at least one raised section of the bar has a notch formed therein which facilitates movement of the hinge plates as the raised section is drawn into one of the openings.

6. The ring metal of claim 5 which pivoting of the trigger in a binder ring closing direction forces the bar to move in the opposite direction and restores the hinge plates to their initial, binder ring closed position.

7. An easy-open ring metal for a binder comprising:

a cover;

at least one binder ring comprising two ring segments;

a pair of hinge plates to one end of each of which one of the segments is attached;

a movable bar extending from one end of the metal to the other, the bar contacting the hinge plates to move them when the binder is to be opened;

a trigger connected to an end of the cover by a pivot pin extending across a base of the trigger and providing a fixed point about which the trigger rotates relative to the cover, the trigger also being connected to one end of the bar to move the bar, the trigger being directly connected to the bar by a slot pin movable through a slot by which, when the trigger is drawn away from a first, binder closed position, to a second, binder open position, the bar moves relative to the hinge plates forcing the hinge plates to pivot the respective segments of the binder rings away from each other and open the binder; and, the slot pin being located relative to the pivot pin so that, as the trigger rotates about its base; the slot pin moves through the slot until it reaches an end thereof, with continued pivoting of the trigger moving the bar in the direction toward the trigger to affect the opening of the binder ring.

* * * * *